US012758033B2

(12) United States Patent
Tian

(10) Patent No.: US 12,758,033 B2
(45) Date of Patent: Oct. 13, 2026

(54) MULTI-FUNCTIONAL LEARNING TOWER

(71) Applicant: Shenzhen Muqiqu Creative Development Co., Ltd., Shenzhen (CN)

(72) Inventor: Qian Tian, Shenzhen (CN)

( * ) Notice: Subject to any disclaimer, the term of this patent is extended or adjusted under 35 U.S.C. 154(b) by 96 days.

(21) Appl. No.: 18/764,130

(22) Filed: Jul. 3, 2024

(65) Prior Publication Data

US 2025/0386952 A1 Dec. 25, 2025

(30) Foreign Application Priority Data

Jun. 19, 2024 (CN) ..... 202421411753.7

(51) Int. Cl.
*A47D 11/00* (2006.01)
*A47D 3/00* (2006.01)
*A63B 9/00* (2006.01)

(52) U.S. Cl.
CPC ..... *A47D 11/002* (2013.01); *A47D 3/00* (2013.01); *A63B 9/00* (2013.01)

(58) Field of Classification Search
CPC ..... A47B 3/00; A47B 47/00; A47B 47/0066; A47B 47/042; A47D 3/00; A47D 11/002; A63B 9/00
USPC ..... 312/240, 241; 108/11, 12, 13, 17, 29, 108/91, 162, 193
See application file for complete search history.

(56) References Cited

U.S. PATENT DOCUMENTS 1,309,097 A * 7/1919 Markwick ..... A47C 13/00 297/188.1
2,089,440 A * 8/1937 Sloan ..... A47B 65/00 5/59.1
2,222,318 A * 11/1940 Mclauthlin ..... A47B 61/06 312/200
2,222,671 A * 11/1940 White ..... D06F 67/005 312/240
2,620,018 A * 12/1952 Pagano ..... A47B 85/04 446/482
3,583,781 A * 6/1971 Yamawaki ..... A47B 3/00 312/258
3,602,561 A * 8/1971 Provost ..... A47B 43/00 297/118
3,905,662 A * 9/1975 Richmond ..... B62B 3/006 312/294

(Continued)

FOREIGN PATENT DOCUMENTS

CN 201441124 * 4/2010 ..... A47B 63/00

*Primary Examiner* — James O Hansen
(74) *Attorney, Agent, or Firm* — Novoclaims Patent Services LLC; Mei Lin Wong

(57) ABSTRACT

The utility model discloses a multi-functional learning tower, comprising a tower base, a tower top, two sets of first flat-mouth fastener assemblies and two sets of second flat-mouth fastener assemblies. The tower base comprises two first side plates, a seat plate, and a first desk board. The tower top comprises two second side plates, anti-falling bars, and a second desk board. The tower top is arranged right above the tower base, and the tower base is hinged to the tower top. A height of the first side plate is the same as that of the second side plate. According to the utility model, the tower base and the tower top are connected by the four sets of fastener assemblies, realizing efficient and convenient transformation between a learning tower and a desk and a secure connection.

5 Claims, 7 Drawing Sheets

(56) References Cited

U.S. PATENT DOCUMENTS

| | | | | | |
|---|---|---|---|---|---|
| 4,709,971 | A * | 12/1987 | Leeds | A47B 21/06 | 312/282 |
| 5,647,632 | A * | 7/1997 | Fireman | A47B 85/00 | 297/283.1 |
| 6,460,950 | B2 * | 10/2002 | Spitzer | B62B 3/005 | 312/249.8 |
| 7,165,689 | B2 * | 1/2007 | McDaniel | A47F 7/24 | 211/116 |
| 2007/0236115 | A1 * | 10/2007 | Casanova Arevalo | A47B 47/005 | 312/257.1 |

* cited by examiner

MULTI-FUNCTIONAL LEARNING TOWER

CROSS REFERENCE OF RELATED APPLICATION

This is a non-provisional application that claims priority to Chinese application number 2024214117537, filing date Jun. 19, 2024, the entire contents of each of which are expressly incorporated herein by reference.

BACKGROUND OF THE PRESENT INVENTION

Field of Invention

The utility model relates to children's furniture, in particular to a multi-functional learning tower.

Description of Related Arts

Children's learning tower, also known as children's study desk and chair set or children's learning workstation, is a type of learning furniture designed specifically for children. This product typically incorporates ergonomic principles, aiming to provide a comfortable and healthy learning environment for children to promote learning efficiency and the development of correct posture.

The utility model with the patent number of CN202323060333.7 discloses a multi-functional learning tower, which comprises a bearing assembly, and a writing assembly for learning is installed at an upper end of the bearing assembly; and the writing assembly comprises a second desk board, a second connecting frame, an anti-falling bar, an installation hole, a white board and a round hole, and a connecting assembly for connecting the bearing assembly and the writing assembly is installed at a lower end of the writing assembly. In this way, the utility model can cultivate children's interest in learning and develop children's hobbies, and can be transformed into a desk, serving multiple purposes and saving resources and space.

The connecting assembly 3 of the utility model comprises a strap 31 and a threaded connecting rod 32. One end of the threaded connecting rod 32 is embedded in and threadedly connected with the installation hole 24, and the other end of the threaded connecting rod 32 passes through and is slidably connected with a through hole 14. When the learning tower becomes a desk, the strap 31 is detachably connected with a first connecting frame 12 and the second connecting frame 22, and the threaded connecting rod 32 is connected with the second connecting frame 22. A length of the second connecting frame 22 in a vertical direction is shorter than that of the first connecting frame 12. When the learning tower is turned into a desk, the threaded connecting rod 32 is rotated so that an upper end of the threaded connecting rod 32 is separated from the installation hole 24 and the through hole 14, a threaded end of the threaded connecting rod 32 is aligned with the round hole 26, the threaded connecting rod 32 is rotated, and then the second connecting frame 22 is rotated to the right, allowing the second connecting frame 22 to drive the second desk board 21, the white board 25 and the anti-falling bar 23 to rotate until the second desk board 21 is flush with a first desk board 11, thus completing the transformation of the learning tower to a desk. The transformation between the learning tower and the desk of the utility model is complicated, and the first connecting frame and the second connecting frame for assembling the desk are connected by straps, which is not secure enough.

SUMMARY OF THE PRESENT INVENTION

The technical problem being addressed by the utility model is to provide a multi-functional learning tower which features efficient and convenient transformation between a learning tower and a desk and a secure connection.

In order to solve the above technical problems, the technical scheme adopted by the utility model is as follows. A multi-functional learning tower comprises a tower base, a tower top, two sets of first flat-mouth fastener assemblies and two sets of second flat-mouth fastener assemblies. The tower base comprises two first side plates, a seat plate, a first front plate, and a first desk board. Two lateral ends of the first desk board are respectively connected with top ends of the two first side plates, and two lateral ends of the seat plate are respectively connected with vertical middle parts of the two first side plates. In a longitudinal direction, the seat plate is arranged at rear ends of the two first side plates, and two lateral ends of the first front plate are respectively connected with front ends of the two first side plates. The tower top comprises two second side plates, anti-falling bars, a second front plate, and a second desk board, and two lateral ends of the second desk board are respectively connected with lower ends of the two second side plates. Two lateral ends of the anti-falling bar are respectively connected with rear ends of the two second side plates. Two lateral ends of the second front plate are respectively connected with front ends of the two second side plates. The tower top is arranged right above the tower base, and a front end of the second desk board is hinged with a front end of the first desk board. The tower base has the same lateral width as the tower top, and a height of the first side plate is the same as that of the second side plate. The two sets of first flat-mouth fastener assemblies are respectively arranged at outer sides of two lateral ends of the multi-functional learning tower and located at rear ends of joints of the first side plates and the second side plates. The two sets of second flat-mouth fastener assemblies are respectively arranged at the outer sides of the two lateral ends of the multi-functional learning tower, a first part of the second flat-mouth fastener assembly is arranged at a lower part of a front end of the first side plate, and a second part of the second flat-mouth fastener assembly is arranged at an upper part of the front end of the second side plate.

According to the above multi-functional learning tower, a duckbill hook of the first flat-mouth fastener assembly is fixed at an upper end of the first side plate, and a fastener of the first flat-mouth fastener assembly is fixed at a lower end of the second side plate; and a duckbill hook of the second flat-mouth fastener assembly is fixed at a lower part of a front end of the first side plate, and a fastener of the second flat-mouth fastener assembly is fixed at an upper part of the front end of the second side plate.

According to the above multi-functional learning tower, the tower base comprises two rear legs, and the two rear legs are respectively arranged at outer sides of two lateral ends of the tower base; the rear leg comprises a first vertical plate and a second vertical plate, and the first vertical plate is arranged in a longitudinal direction and the second vertical plate is arranged in a lateral direction; and a front end of the first vertical plate is fixed at a lower part of a rear end of the first side plate, and an inner end of the second vertical plate is connected with the front end of the first vertical plate.

According to the above multi-functional learning tower, a middle part of a front end of the first side plate is provided with a vertical groove, and a middle part of a rear end of the first side plate is provided with a longitudinal groove; ends of the first front plate are embedded in the vertical grooves of the first side plates, and the first front plate is connected with the first side plates by screws; a rear end of the longitudinal groove of the first side plate is open, and ends of the seat plate are embedded in the longitudinal grooves of the first side plates; the seat plate is connected with the first side plates by screws, and a rear end of the seat plate protrudes outward from the rear end openings of the longitudinal grooves of the first side plates; and ends of the first desk board are connected with the first side plates by screws, and a middle part of a rear end of the first desk board comprises a first human body avoidance groove.

According to the above multi-functional learning tower, the tower top comprises a black board and a hand screw; a front end of the second side plate is provided with a vertical groove, and a bottom part of the second front plate is provided with a lateral groove; ends of the second front plate are fixed to upper parts of the second side plates by screws; and two ends of the black board are respectively embedded in the vertical grooves of the two second side plates, and an upper end of the black board is embedded in the lateral groove in the bottom part of the second front plate.

According to the above multi-functional learning tower, the tower top comprises a hand screw, the anti-falling bars comprise an upper anti-falling bar and a lower anti-falling bar, the upper anti-falling bar is arranged at an upper part of the tower top, and the lower anti-falling bar is arranged at a lower part of the tower top; each second side plate has a first stepped hole corresponding to two ends of the upper anti-falling bar, ends of the upper anti-falling bar are embedded in large holes of the first stepped holes of the second side plates and connected with the second side plates by screws; one of the second side plates has a second stepped hole corresponding to a first end of the lower anti-falling bar, and the first end of the lower anti-falling bar is embedded in a large hole of the second stepped hole of the second side plate, and connected with the second side plate by the hand screw; and the other second side plate has an arc groove corresponding to a second end of the lower anti-falling bar, an upper end of the arc groove is provided with an opening at an edge of the second side plate, and the second end of the lower anti-falling bar is embedded in a lower end of the arc groove.

According to the above multi-functional learning tower, a second human body avoidance groove is formed in a middle part of a rear end of the second desk board, and a depth of the second human body avoidance groove in the longitudinal direction is smaller than that of the first human body avoidance groove in the longitudinal direction.

According to the above multi-functional learning tower, a top surface of the seat plate is provided with an anti-slip layer.

According to the above multi-functional learning tower, the first side plates and the second side plates are integral panel structures.

When the multi-functional learning tower provided by the utility model is used as a learning tower and a desk, the tower base and the tower top are connected by the two sets of first flat-mouth fastener assemblies or two sets of second flat-mouth fastener assemblies, realizing efficient and convenient transformation between a learning tower and a desk and a secure connection.

BRIEF DESCRIPTION OF THE DRAWINGS

The utility model will be further explained with reference to the attached drawings and specific implementation modes.

DETAILED DESCRIPTION OF THE PREFERRED EMBODIMENT

Figure 1:
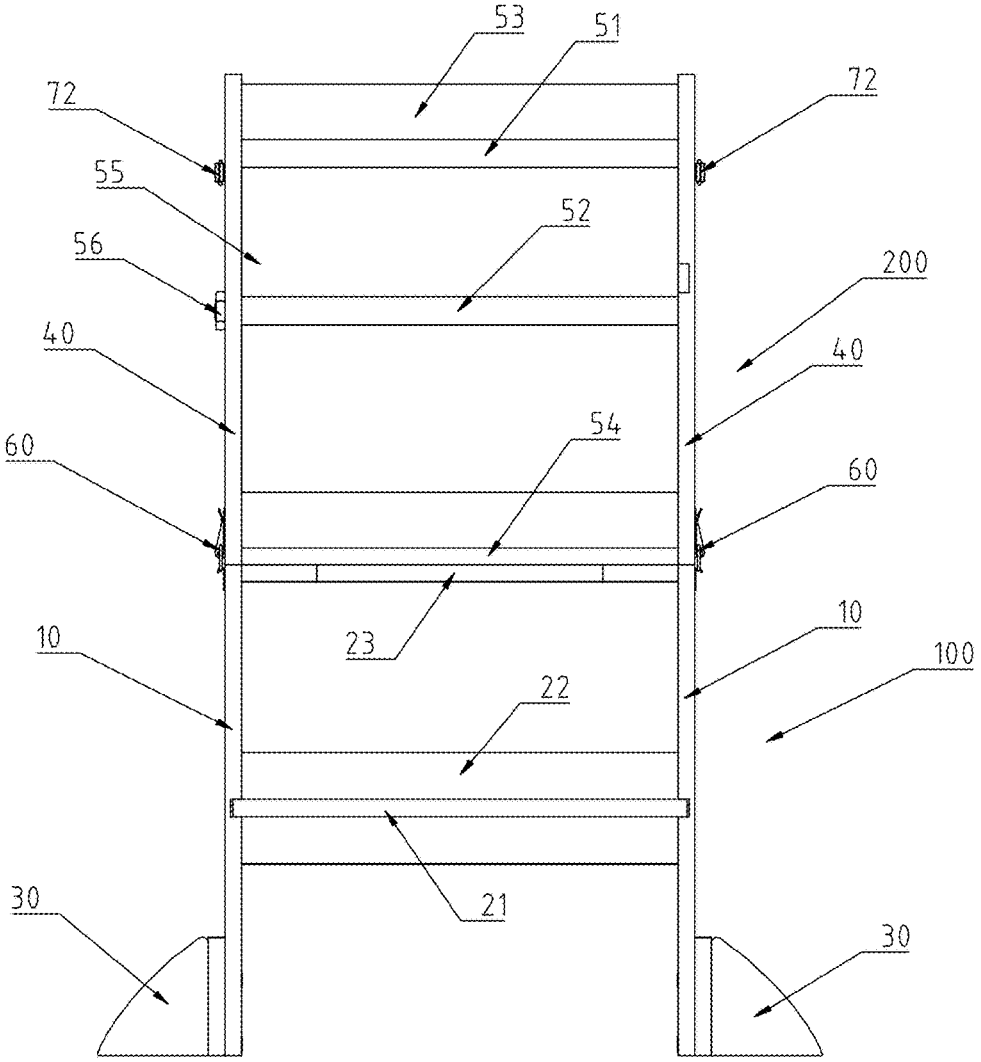
FIG. 1 is a front view of a multi-functional learning tower according to an embodiment of the utility model.
Figure 2:
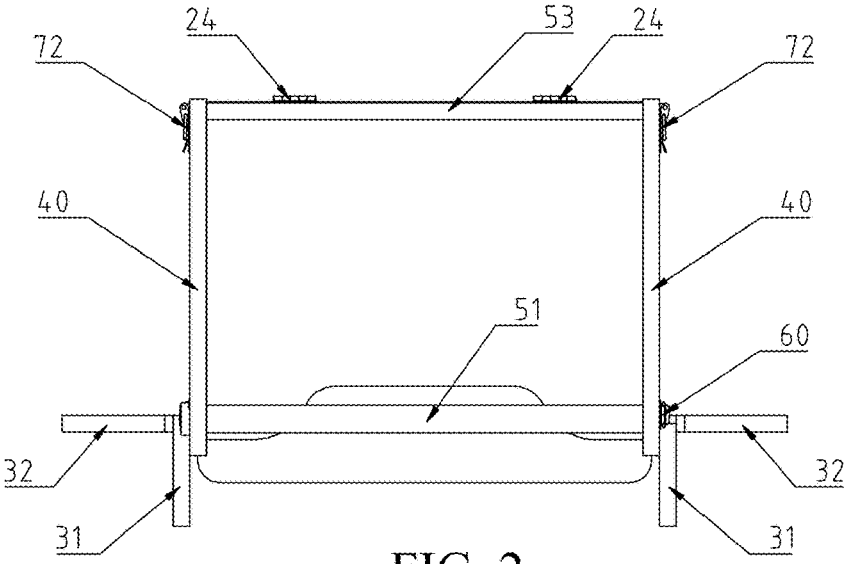
FIG. 2 is a top view of a multi-functional learning tower according to an embodiment of the utility model.
Figure 3:
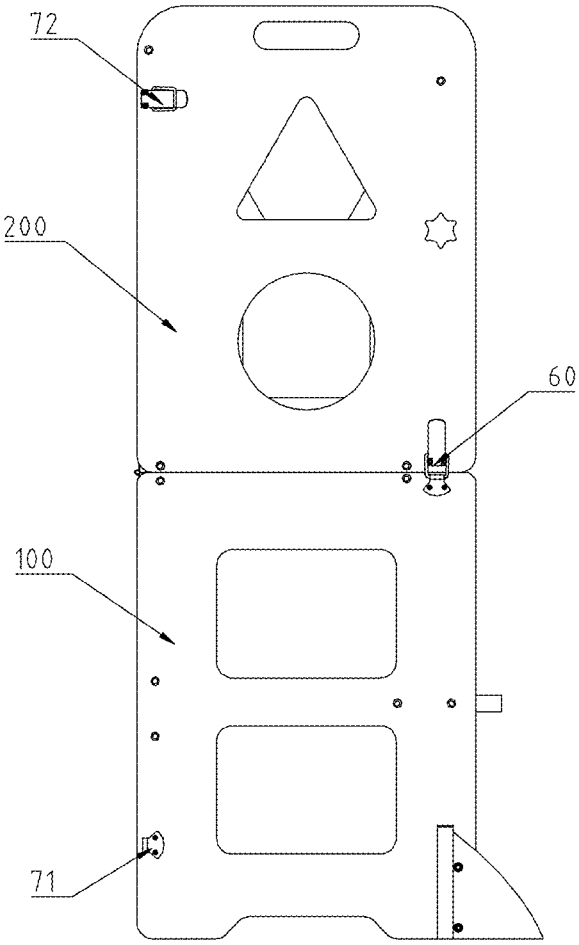
FIG. 3 is a left view of a multi-functional learning tower according to an embodiment of the utility model.
Figure 4:
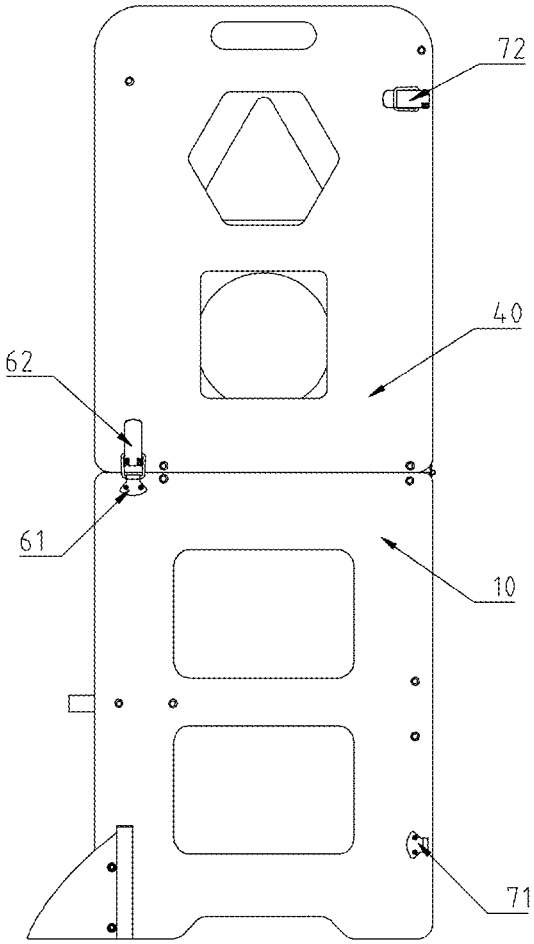
FIG. 4 is a right view of a multi-functional learning tower according to an embodiment of the utility model.
Figure 5:
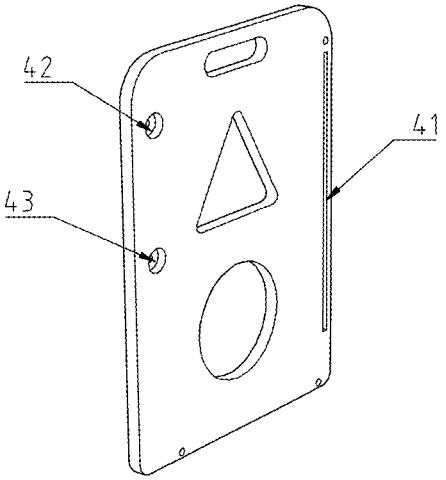
FIG. 5 is a perspective view of a second side plate according to an embodiment of the utility model.
Figure 6:
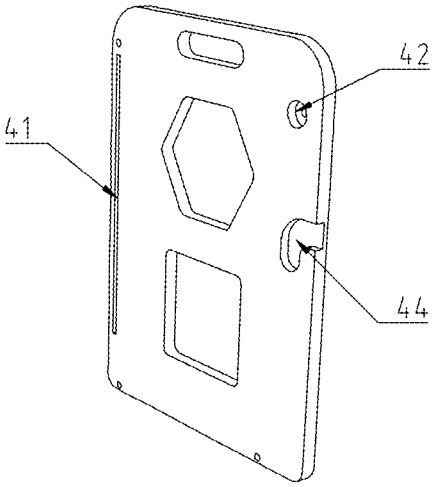
FIG. 6 is a perspective view of another second side plate according to an embodiment of the utility model.
Figure 7:
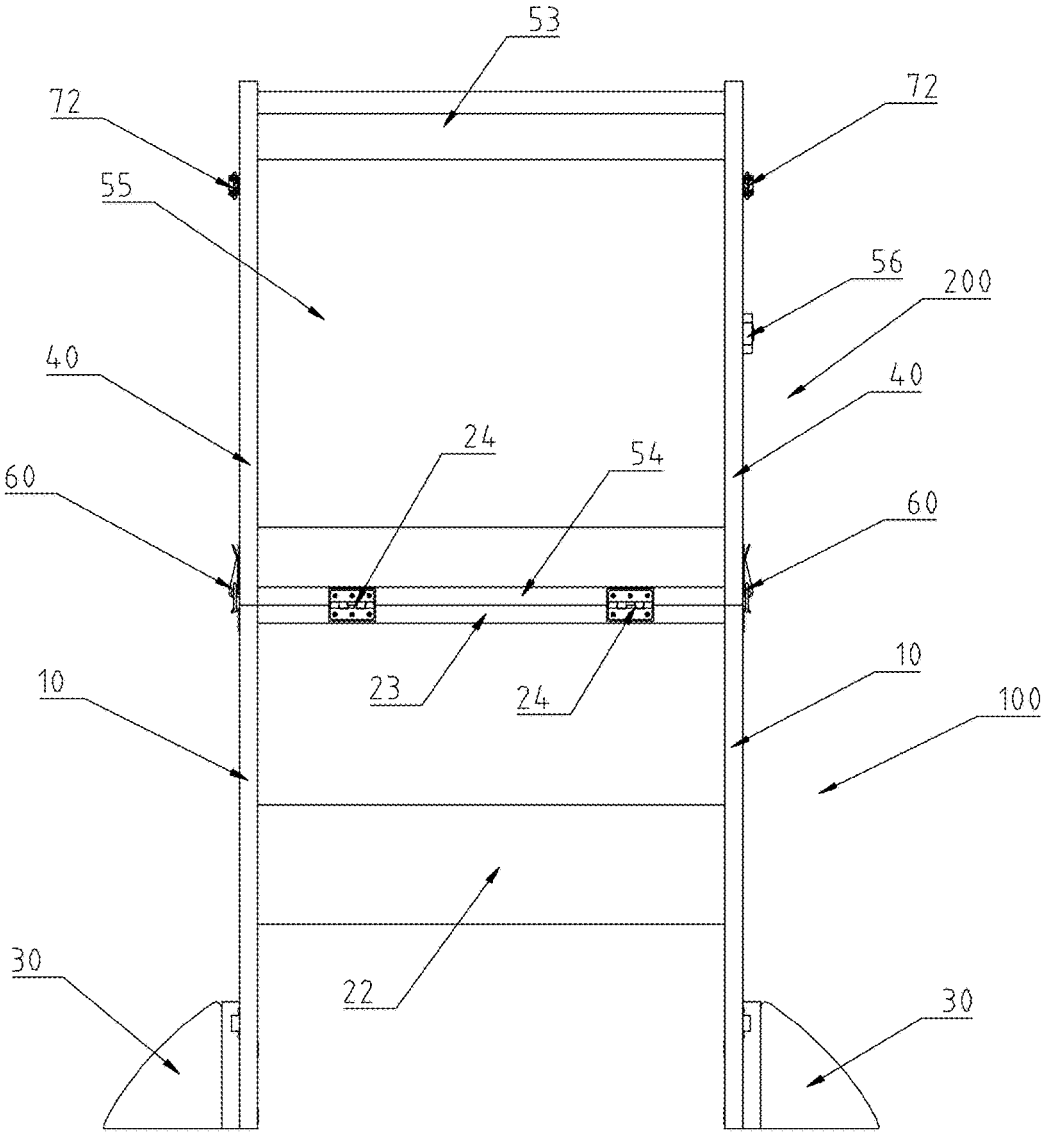
FIG. 7 is a rear view of a multi-functional learning tower according to an embodiment of the utility model.
Figure 8:
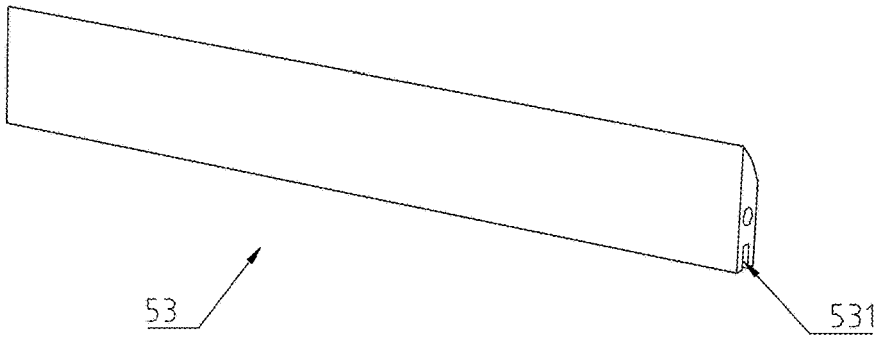
FIG. 8 is a perspective view of a second front plate according to an embodiment of the utility model.
Figure 9:
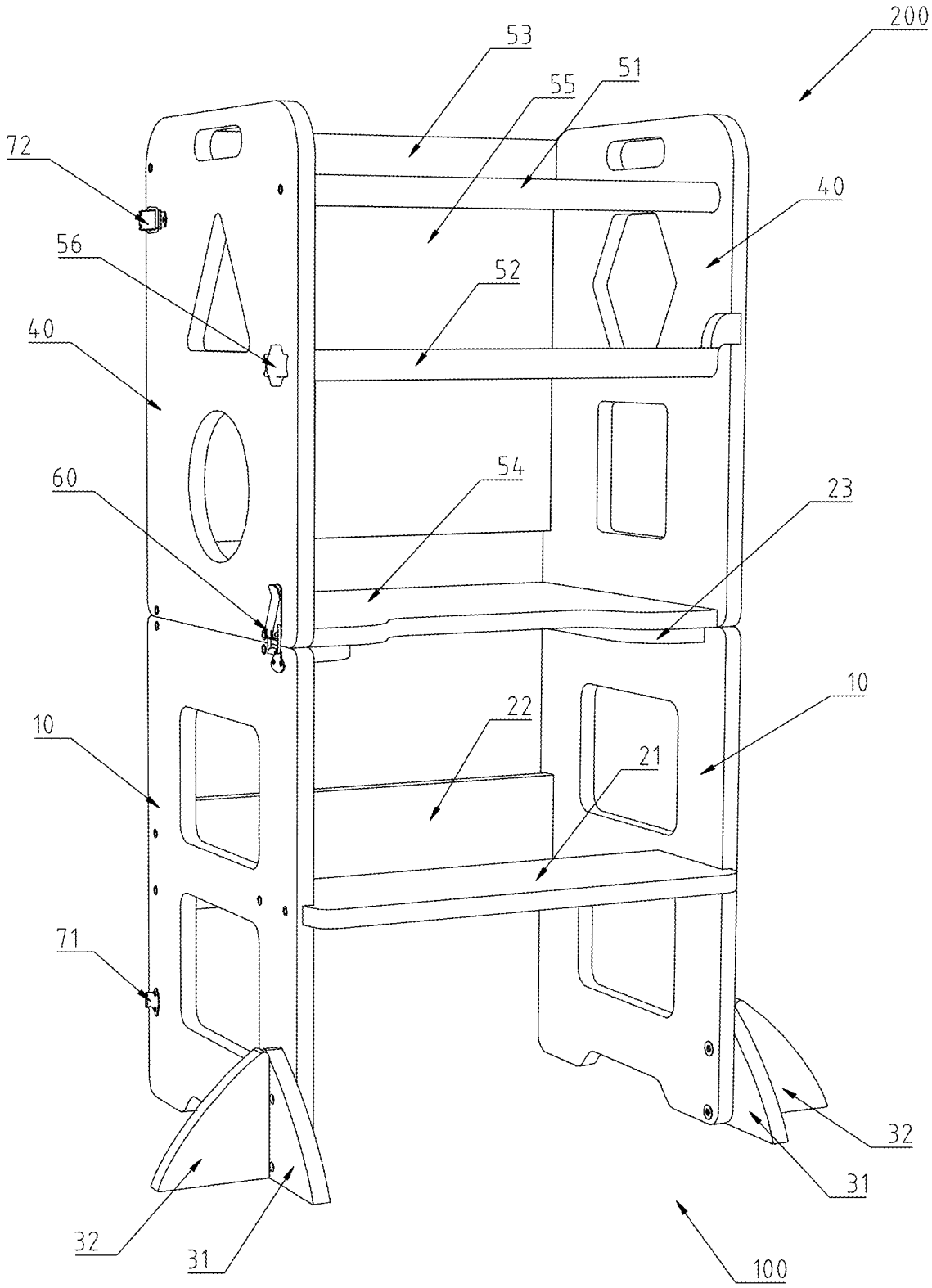
FIG. 9 is a perspective view of a multi-functional learning tower according to an embodiment of the utility model.
Figure 10:
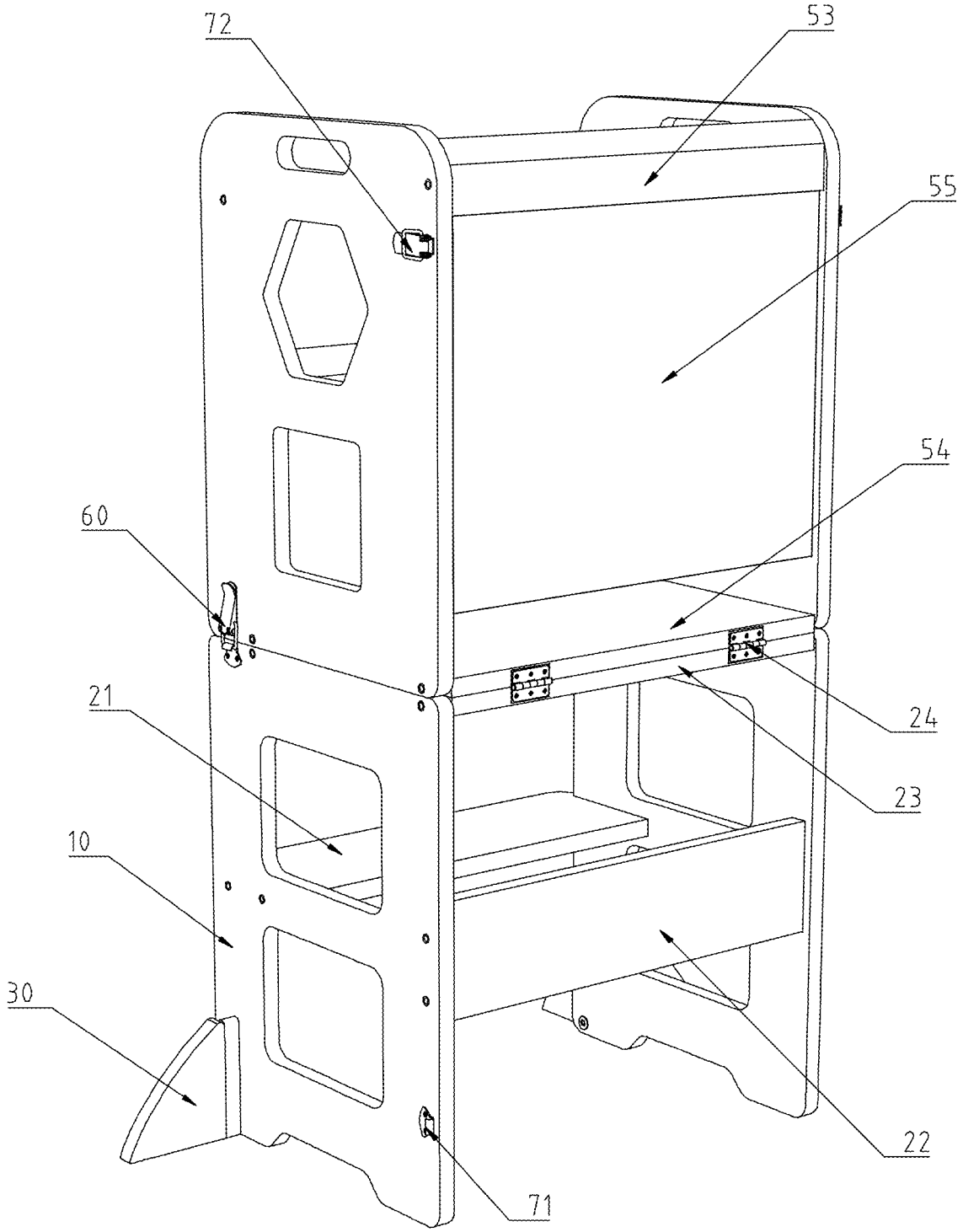
FIG. 10 is a perspective view of a multi-functional learning tower from another viewing angle according to an embodiment of the utility model.

The structure of a multi-functional learning tower provided by an embodiment of the utility model is shown in FIGS. 1-15, which comprises a tower base 100, a tower top 200, two sets of first flat-mouth fastener assemblies 60 and two sets of second flat-mouth fastener assemblies 70.

The tower base 100 comprises two first side plates 10, a seat plate 21, a first front plate 22, a first desk board 23 and two rear legs 30. Two lateral ends of the first desk board 23 are respectively connected with top ends of the two first side plates 10 by screws, and two lateral ends of the seat plate 21 are respectively connected with vertical middle parts of the two first side plates 10. In a longitudinal direction, the seat plate 21 is arranged at rear ends of the two first side plates 10, and two lateral ends of the first front plate 22 are respectively connected with front ends of the two first side plates 10.

A middle part of a front end of the first side plate 10 is provided with a vertical groove 11, and a middle part of a rear end of the first side plate 10 is provided with a longitudinal groove 12. Ends of the first front plate 22 are embedded in the vertical grooves 11 of the first side plates 10 and connected with the first side plates 10 by screws. A rear end of the longitudinal groove 12 of the first side plate 10 is open, and ends of the seat plate 21 are embedded in the longitudinal grooves 12 of the first side plates 10. The seat plate 21 is connected with the first side plates 10 by screws, and a rear end of the seat plate 21 protrudes outward from the rear end openings of the longitudinal grooves 12 of the first side plates 10. A top surface of the seat plate 21 is provided with an anti-slip layer. Ends of the first desk board 23 are connected with the first side plates 10 by screws, and a middle part of a rear end of the first desk board 23 comprises a first human body avoidance groove 231.

The two rear legs 30 are respectively arranged at outer sides of two lateral ends of the tower base 100. The rear leg 30 comprises a first vertical plate 31 and a second vertical plate 32. The first vertical plate 31 is arranged in a longitudinal direction and the second vertical plate 32 is arranged in a lateral direction. A front end of the first vertical plate 31 is fixed at a lower part of a rear end of the first side plate 10 by screws 33, and an inner end of the second vertical plate 32 is connected with the front end of the first vertical plate 31 by screws.

The two rear legs 30 may enlarge the ground contact area of the tower base 100, thus improving the stability of the learning tower.

The tower top 200 comprises two second side plates 40, an upper anti-falling bar 51, a lower anti-falling bar 52, a second front plate 53, a second desk board 54, a black board 55 and a hand screw 56, and two lateral ends of the second desk board 54 are respectively connected with lower ends of the two second side plates 40 through screws.

A front end of the second side plate 40 is provided with a vertical groove 41, and a bottom part of the second front plate 53 is provided with a lateral groove 531. Two ends of the black board 55 are respectively embedded in the vertical grooves 41 of the two second side plates 40, and an upper end of the black board 55 is embedded in the lateral groove in the bottom part of the second front plate 53. Two lateral ends of the second front plate 53 are respectively connected with front ends of the two second side plates 40 and fixed at upper parts of the second side plates 40 by screws.

The upper anti-falling bar 51 is arranged at an upper part of the tower top 200, with threaded holes at two ends. The lower anti-falling bar 52 is arranged at a lower part of the tower top 200, with a threaded hole at one end. Each second side plate 40 has a first stepped hole 42 corresponding to two ends of the upper anti-falling bar 51. Ends of the upper anti-falling bar 51 are embedded in large holes of the first stepped holes 42 in inner sides of the second side plates 40 and connected with the second side plates 40 by screws. The left second side plate 40 has a second stepped hole 43 corresponding to a first end of the lower anti-falling bar 52. An end of the lower anti-falling bar 52 with the threaded hole is embedded in a large hole of the second stepped hole 43 in an inner side of the left second side plate 40, and is connected with the second side plate 40 by the hand screw 56. The right second side plate 40 has an arc groove 44 corresponding to an end of the lower anti-falling bar 52 without a threaded hole, an upper end of the arc groove 44 is provided with an opening at an edge of the second side plate 40 for the end of the lower anti-falling bar 52 to enter and exit, and the end of the lower anti-falling bar 52 without a threaded hole is embedded in a lower end of the arc groove 44 of the right second side plate 40.

The multi-functional learning tower provided by the embodiment of the utility model adopts two anti-falling bars, and the upper anti-falling bar 51 is arranged at a higher position, which can enhance the safety. The lower anti-falling bar 52 adopts a detachable structure, which can be removed when the learning tower is turned into a desk and chair set. When older children use the learning tower, the lower anti-falling bar 52 can be removed. The lower anti-falling bar 52 can be removed when children climb the learning tower. However, the lower anti-falling bar 52 should be installed when younger children stand on the learning tower.

A second human body avoidance groove 541 is formed in a middle part of a rear end of the second desk board 54. A depth of the second human body avoidance groove 541 in the longitudinal direction is smaller than that of the first human body avoidance groove 231 in the longitudinal direction.

The tower base 100 has the same lateral width as the tower top 200, and a height of the first side plate 10 is the same as that of the second side plate 40. When the multi-functional learning tower provided by the embodiment of the utility model is used as a learning tower, the tower top 200 is arranged right above the tower base 100, and a front end of the second desk board 54 of the tower top 200 is hinged with a front end of the first desk board 23 of the tower base 100 through a hinge 24.

The two sets of first flat-mouth fastener assemblies 60 are respectively arranged at outer sides of two lateral ends of the multi-functional learning tower, and are located at rear ends of joints of the first side plates 10 and the second side plates 40. A duckbill hook 61 of the first flat-mouth fastener assembly 60 is fixed at an upper end of the first side plate 10, and a fastener 62 of the first flat-mouth fastener assembly 60 is fixed at a lower end of the second side plate 40.

The two sets of second flat-mouth fastener assemblies 70 are respectively arranged at the outer sides of the two lateral ends of the multi-functional learning tower. A duckbill hook 71 of the second flat-mouth fastener assembly 70 is fixed at a lower part of a front end of the first side plate 10, and a fastener 72 of the second flat-mouth fastener assembly 70 is fixed at an upper part of the front end of the second side plate 40.

As shown in FIGS. 3, 4, 7, 9 and 10, when the multi-functional learning tower provided by the embodiment of the utility model is used as a learning tower, the fastener 62 of the first flat-mouth fastener assembly 60 is fastened on the duckbill hook 61, so that the learning tower is steadfastly kept in an upright state.

The multi-functional learning tower provided by the embodiment of the utility model is panel furniture, and the main components of the multi-functional learning tower, the first side plates 10 and the second side plates 40, are all integral panel structures.

Figure 11:
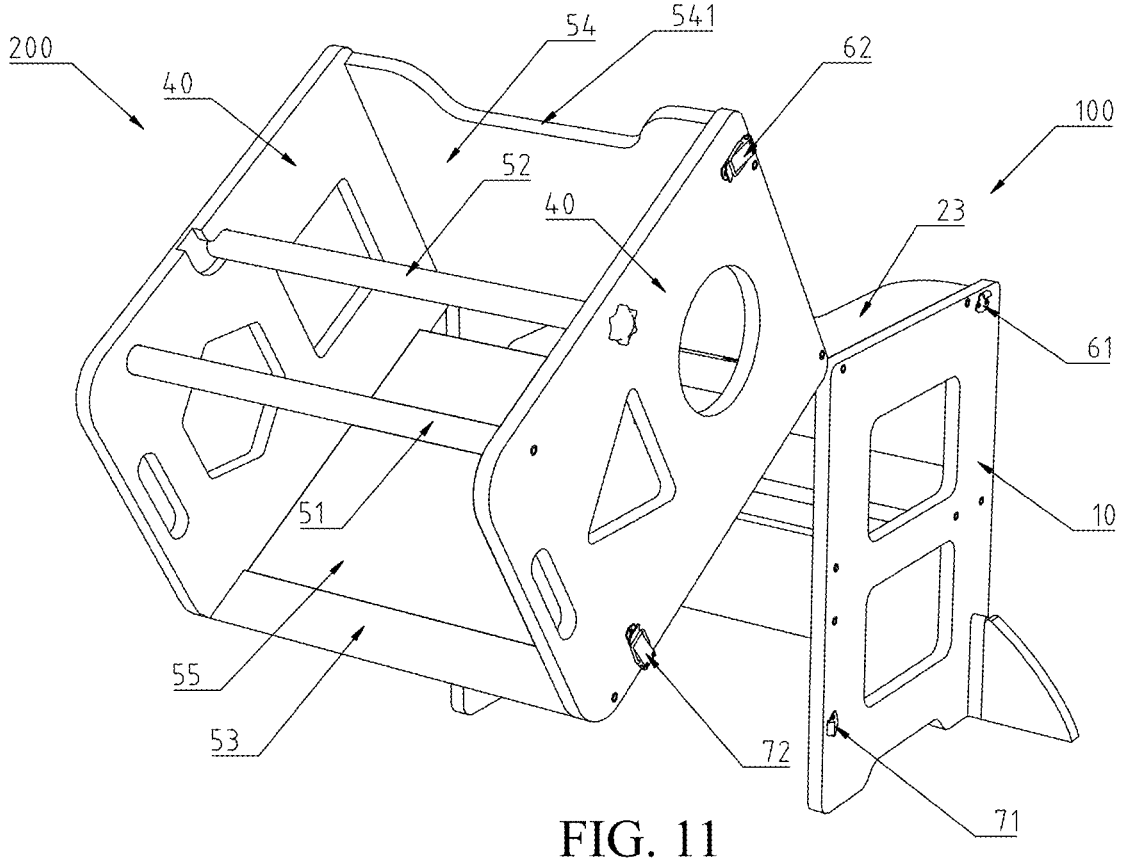
FIG. 11 is a perspective view of a transformation process of a multi-functional learning tower according to an embodiment of the utility model.
Figure 12:
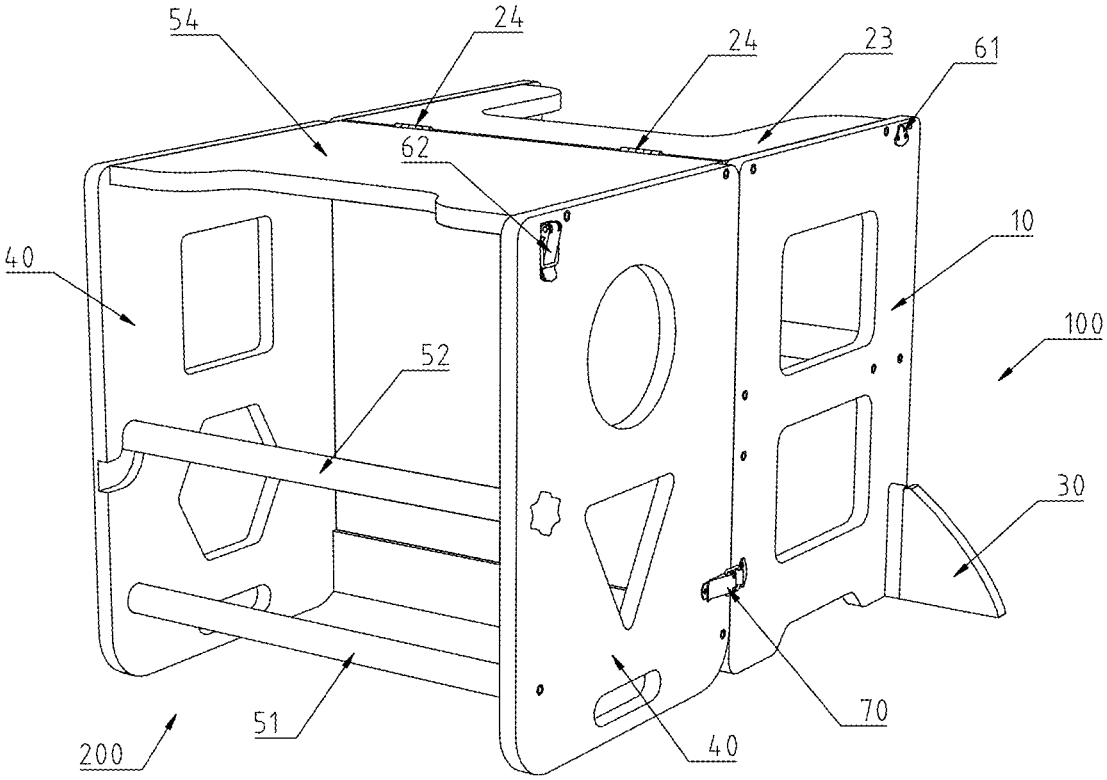
FIG. 12 is a perspective view of a multi-functional learning tower transformed into a desk according to an embodiment of the utility model.
Figure 13:
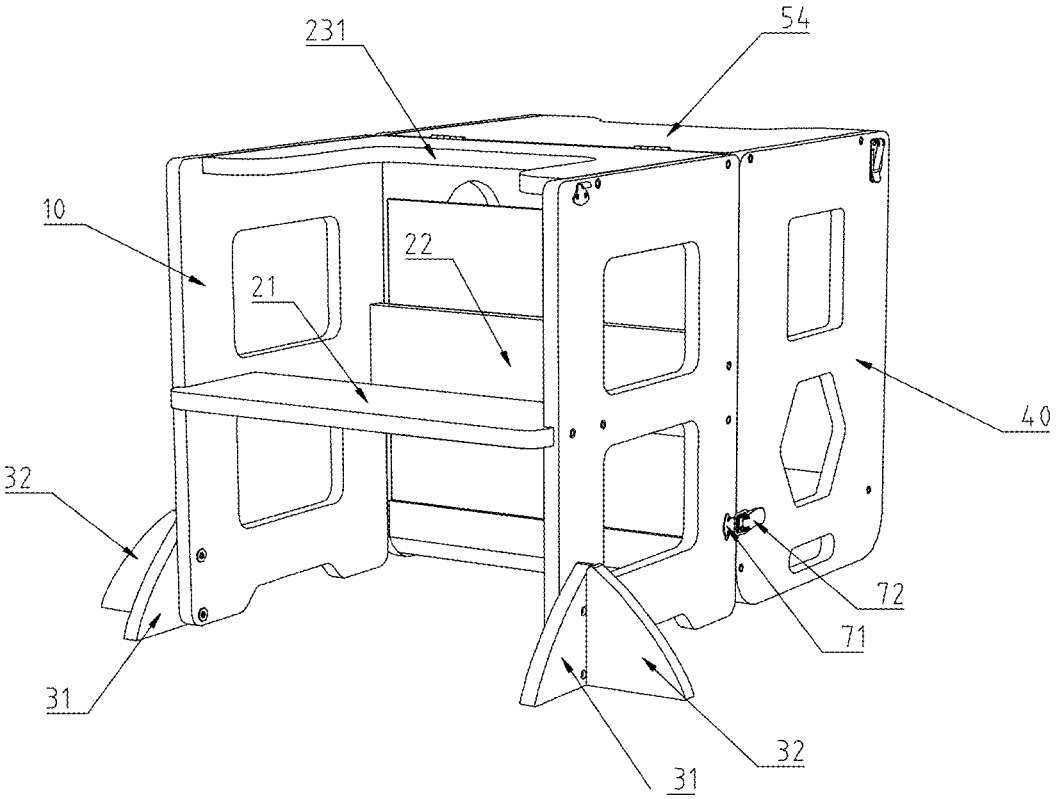
FIG. 13 is a perspective view of a transformed desk from another viewing angle according to an embodiment of the utility model.
Figure 14:
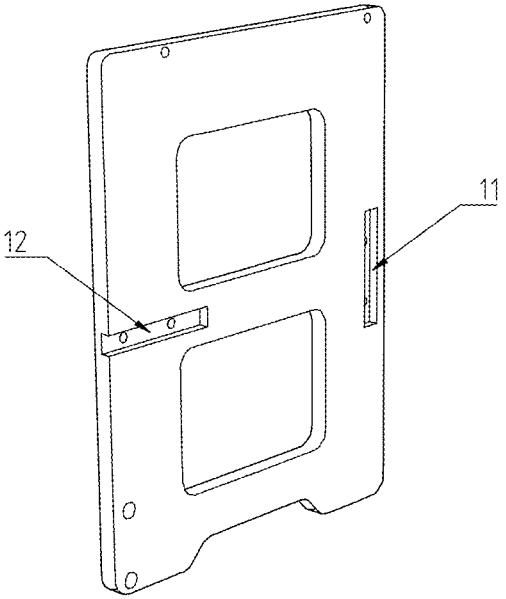
FIG. 14 is a perspective view of a first side plate according to an embodiment of the utility model.
Figure 15:
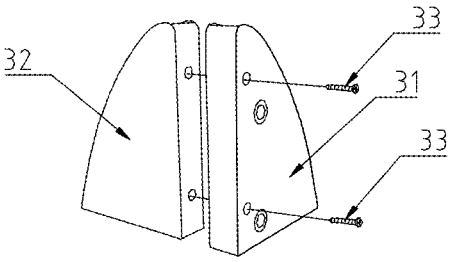
FIG. 15 is an exploded view of a rear leg according to an embodiment of the utility model.

When the multi-functional learning tower provided by the embodiment of the utility model is used as a desk, as shown in FIGS. 11-13, the fastener 62 of the first flat-mouth fastener assembly 60 is opened, and the tower top 200 is rotated downward by 180 degrees around the hinge 24; when a front edge of the second side plate 40 of the tower top 200 is flush with a front edge of the first side plate 10 of the tower base 100, the duckbill hooks 71 and the fasteners 72 of the two sets of second flat-mouth fastener assemblies 70 are aligned in height; at this point, the fasteners 72 of the two sets of 10 second flat-mouth fastener assemblies 70 are fastened onto the duckbill hooks 71, to lock the tower base 100 and the tower top 200 together, thus completing the transformation of the multi-functional learning tower to a desk.

What is claimed is:

1. A multi-functional learning tower, comprising a tower base and a tower top, wherein the tower base comprises two first side plates, a seat plate, a first front plate, and a first desk board; two lateral ends of the first desk board are respectively connected with top ends of the two first side plates, and two lateral ends of the seat plate are respectively connected with vertical middle parts of the two first side plates; in a longitudinal direction, the seat plate is arranged at rear ends of the two first side plates, and two lateral ends of the first front plate are respectively connected with front ends of the two first side plates; the tower top comprises two second side plates, anti-falling bars, a second front plate, and a second desk board, and two lateral ends of the second desk board are respectively connected with lower ends of the two second side plates; two lateral ends of the anti-falling bars are respectively connected with the two second side plates; two lateral ends of the second front plate are respectively connected with front ends of the two second side plates; the tower top is arranged right above the tower base, and a front end of the second desk board is hinged with a front end of the first desk board; two sets of first flat-mouth fastener assemblies and two sets of second flat-mouth fastener assemblies are further provided; the tower base has the same lateral width as the tower top, and a height of the first side plate is the same as that of the second side plate; the two sets of first flat-mouth fastener assemblies are respectively arranged at outer sides of two lateral ends of the multi-functional learning tower and located at rear ends of joints of the first side plates and the second side plates; and the two sets of second flat-mouth fastener assemblies are respectively arranged at the outer sides of the two lateral ends of the multi-functional learning tower, a first part of the second flat-mouth fastener assembly is arranged at a lower part of a front end of the first side plate, and a second part of the second flat-mouth fastener assembly is arranged at an upper part of the front end of the second side plate, wherein a middle part of a front end of the first side plate is provided with a vertical groove, and a middle part of a rear end of the first side plate is provided with a longitudinal groove; ends of the first front plate are embedded in the vertical grooves of the first side plates, and the first front plate is connected with the first side plates by screws; a rear end of the longitudinal groove of the first side plate is open, and ends of the seat plate are embedded in the longitudinal grooves of the first side plates; the seat plate is connected with the first side plates by screws, and a rear end of the seat plate protrudes outward from the rear end openings of the longitudinal grooves of the first side plates; and ends of the first desk board are connected with the first side plates by screws, and a middle part of a rear end of the first desk board comprises a first human body avoidance groove.

2. The multi-functional learning tower according to claim 1, wherein a second human body avoidance groove is formed in a middle part of a rear end of the second desk board, and a depth of the second human body avoidance groove in the longitudinal direction is smaller than that of the first human body avoidance groove in the longitudinal direction.

3. The multi-functional learning tower according to claim 1, wherein the first side plates and the second side plates are integral panel structures.

4. A multi-functional leaning tower, comprising a tower base and a tower top, wherein the tower base comprises two first side plates, a seat plate, a first front plate, and a first desk board; two lateral ends of the first desk board are respectively connected with top ends of the two first side plates, and two lateral ends of the seat plate are respectively connected with vertical middle parts of the two first side plates: in a longitudinal direction, the seat plate is arranged at rear ends of the two first side plates, and two lateral ends of the first front plate are respectively connected with front ends of the two first side plates; the tower top comprises two second side plates, anti-falling bars, a second front plate, and a second desk board, and two lateral ends of the second desk board are respectively connected with lower ends of the two second side plates: two lateral ends of the anti-falling bars are respectively connected with the two second side plates; two lateral ends of the second front plate are respectively connected with front ends of the two second side plates: the tower top is arranged right above the tower base, and a front end of the second desk board is hinged with a front end of the first desk board; two sets of first flat-mouth fastener assemblies and two sets of second flat-mouth fastener assemblies are further provided; the tower base has the same lateral width as the tower top, and a height of the first side plate is the same as that of the second side plate: the two sets of first flat-mouth fastener assemblies are respectively arranged at outer sides of two lateral ends of the multi-functional learning tower and located at rear ends of joints of the first side plates and the second side plates; and the two sets of second flat-mouth fastener assemblies are respectively arranged at the outer sides of the two lateral ends of the multi-functional learning tower, a first part of the second flat-mouth fastener assembly is arranged at a lower part of a front end of the first side plate, and a second part of the second flat-mouth fastener assembly is arranged at an upper part of the front end of the second side plate, wherein the tower top comprises a black board and a hand screw; a front end of the second side plate is provided with a vertical groove for each of the second side plates, and a bottom part of the second front plate is provided with a lateral groove; ends of the second front plate are fixed to upper parts of the second side plates by screws; and two ends of the black board are respectively embedded in the vertical grooves of the two second side plates, and an upper end of the black board is embedded in the lateral groove in the bottom part of the second front plate.

5. A multi-functional learning tower, comprising a tower base and a tower top, wherein the tower base comprises two first side plates, a seat plate, a first front plate, and a first desk board; two lateral ends of the first desk board are respectively connected with top ends of the two first side plates, and two lateral ends of the seat plate are respectively connected with vertical middle parts of the two first side plates: in a longitudinal direction, the seat plate is arranged at rear ends of the two first side plates, and two lateral ends of the first front plate are respectively connected with front ends of the two first side plates: the tower top comprises two second side plates, anti-falling bars, a second front plate, and a second desk board, and two lateral ends of the second desk board are respectively connected with lower ends of the two second side plates; two lateral ends of the anti-falling bars are respectively connected with the two second side plates; two lateral ends of the second front plate are respectively connected with front ends of the two second side plates: the tower top is arranged right above the tower base, and a front end of the second desk board is hinged with a front end of the first desk board; two sets of first flat-mouth fastener assemblies and two sets of second flat-mouth fastener assemblies are further provided; the tower base has the same lateral width as the tower top, and a height of the first side plate is the same as that of the second side plate: the two sets of first flat-mouth fastener assemblies are respectively arranged at outer sides of two lateral ends of the multi-functional learning tower and located at rear ends of joints of the first side plates and the second side plates; and the two sets of second flat-mouth fastener assemblies are respectively arranged at the outer sides of the two lateral ends of the multi-functional learning tower, a first part of the second flat-mouth fastener assembly is arranged at a lower part of a front end of the first side plate, and a second part of the second flat-mouth fastener assembly is arranged at an upper part of the front end of the second side plate, wherein the tower top comprises a hand screw, the anti-falling bars comprise an upper anti-falling bar and a lower anti-falling bar, the upper anti-falling bar is arranged at an upper part of the tower top, and the lower anti-falling bar is arranged at a lower part of the tower top; each second side plate has a first stepped hole corresponding to two ends of the upper anti-falling bar, ends of the upper anti-falling bar are embedded in large holes of the first stepped holes of the second side plates and connected with the second side plates by screws; one of the second side plates has a second stepped hole corresponding to a first end of the lower anti-falling bar, and the first end of the lower anti-falling bar is embedded in a large hole of the second stepped hole of the second side plate, and connected with the second side plate by the hand screw; and the other second side plate has an arc groove corresponding to a second end of the lower anti-falling bar, an upper end of the arc groove is provided with an opening at an edge of the second side plate, and the second end of the lower anti-falling bar is embedded in a lower end of the arc groove.

* * * * *